United States Patent [19]

Rigel

[11] Patent Number: 4,911,728

[45] Date of Patent: Mar. 27, 1990

[54] THROWING AID

[76] Inventor: Timothy L. Rigel, 1850 Crescent Dr., Springfield, Ohio 45504

[21] Appl. No.: 129,666

[22] Filed: Dec. 7, 1987

[51] Int. Cl.[4] ..... A63B 69/40

[52] U.S. Cl. ..... 273/26 C; 273/189 A; 273/54 B

[58] Field of Search ..... 273/54 B, 189 A, 189 R, 273/26 C, 29 A, 183 B; 128/90, 87, 89 R

[56] References Cited

U.S. PATENT DOCUMENTS

| | | | |
|---|---|---|---|
| 477,944 | 10/1851 | Bliss | 273/189 A |
| 1,414,012 | 4/1922 | Flint | 273/189 A |
| 1,418,637 | 6/1922 | Flood | 273/189 A |
| 2,468,580 | 4/1949 | Weis et al. | 273/189 A |
| 2,809,042 | 10/1957 | Wasley | 273/189 A |
| 3,419,276 | 12/1968 | Poggioli | 273/189 A |
| 3,436,075 | 4/1969 | Robinson | 273/54 BA |
| 3,975,015 | 8/1976 | Owens et al. | 273/189 A |

*Primary Examiner*—T. Brown

*Attorney, Agent, or Firm*—Fleit, Jacobson, Cohn, Price, Holman & Stern

[57] ABSTRACT

The "Throwing Aid" consists of a base of a flexible but substantially rigid material, approximately the width and length of the thrower's forearm. It is attachable to the back of the arm, centered at the elbow, and contoured to fit the arm snugly but with a bend to hold the arm in a slightly bent position. The base has a central portion bent inwardly so that its opposite ends converge towards each other. The side edges of the base converge toward each other to form an inner side concave face. The converging ends of the base converge on the inner side of the base.

1 Claim, 1 Drawing Sheet

10
12
14
16
18
20
22
24
26
28
30
32
34
36
38
40
42
44
46
48
2
3
A
P

THROWING AID

BACKGROUND OF THE INVENTION

The Throwing Aid is a device designed to force a person to use a particular motion when throwing a ball. It forces a circular or windmill motion when throwing a ball overhand, thus correcting a common, incorrect throwing motion. Many people throw a ball by bringing it back by the ear and then forward. The Throwing Aid, attached to the arm, forces the thrower to bring the ball from in front of the body, past the thigh, extending the almost straight arm in a circular motion over the top of the head and back to the front of the body. The method of attaching the aid to the arm is irrelevant; the Throwing Aid has been attached using Velcro and elastic with both methods obtaining the desired results.

OBJECTS AND ADVANTAGES

The object of the Throwing Aid is to force the thrower to make a circular or windmill motion when throwing a ball. This circular motion allows the thrower to use his entire body, arm, wrist and fingers. The advantage of this Throwing Aid is to correct someone who "short-strokes" the ball (brings the ball back by the ear instead of the hip). A person who "short-strokes" the ball uses his arm and shoulder, limiting velocity and creating a greater chance of injury to the arm and shoulder. The most important part of the circular motion is the use of the wrist and fingers. Throwing is an unnatural act for the elbow and shoulders; throwing correctly, using the wrist and fingers, can reduce the strain on the shoulder and elbow.

REFERENCE NUMERALS—PARTS LIST

FIGS. 1–5

Figures 1, 2, 3, 4, 5, 6:
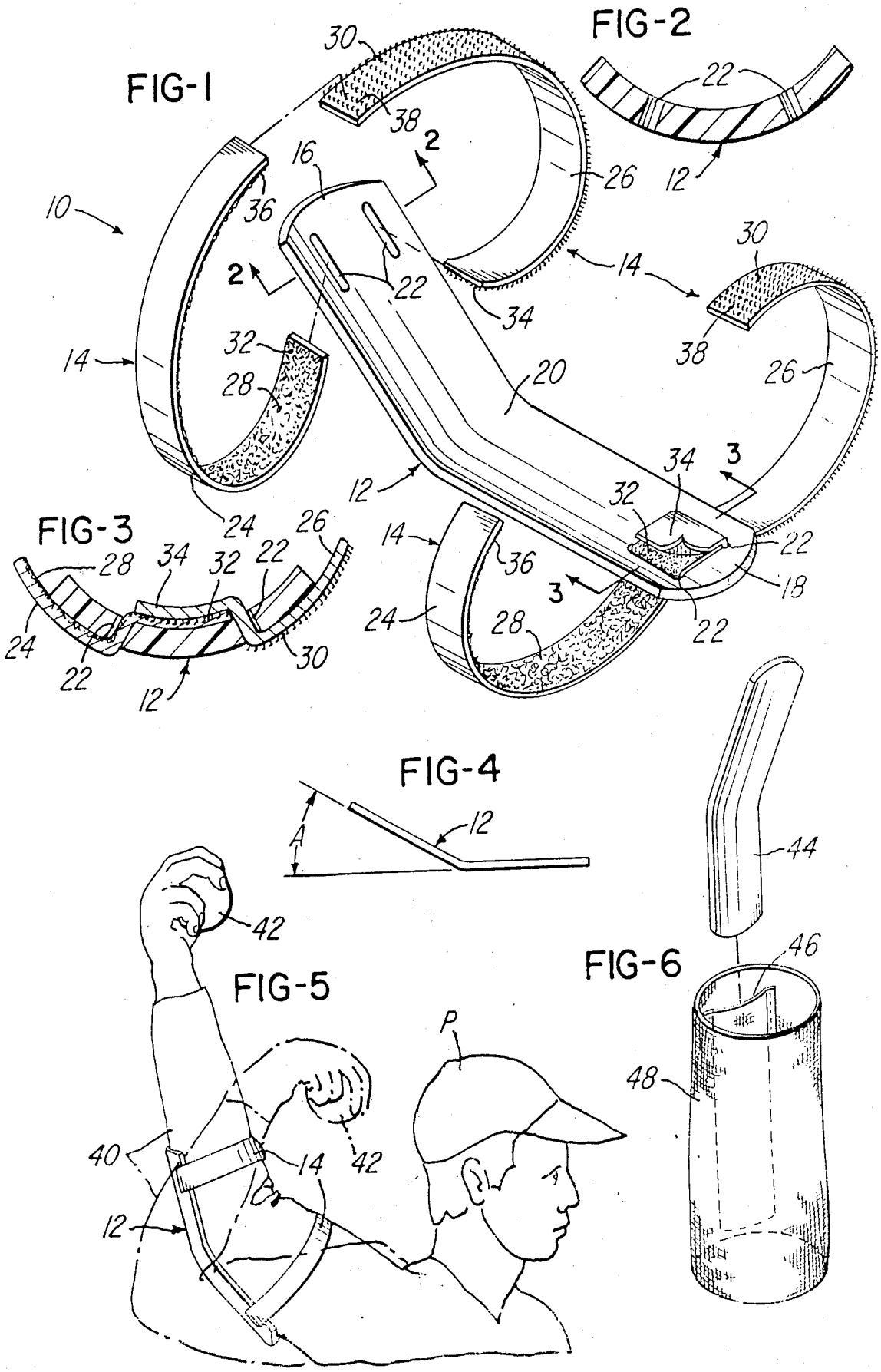
FIG. 1 is a perspective of the entire Throwing Aid. It consists of the base and four pieces of Velcro that are used to attach the Aid to the arm.
FIG. 2 is a cross section of the end which shows the slots for the Velcro and curve of the base. The curve adds comfort and stabilizes the base.
FIG. 3 is the same cross section as FIG. 2 except that it shows the positions of the Velcro strips while in the slots.
FIG. 4 shows the base from a side view. This displays the angle which provides comfort and allows for the slight bending of the elbow that is necessary for the throwing motion.
FIG. 5 shows a player wearing the Throwing Aid. Notice the position of the ball with the Aid and without the Aid. The Aid is forcing the desired position of the arm.
FIG. 6 shows the base in an elastimeric sleeve. The purpose of this figure is to show that there are alternate methods of attaching the base to the arm, such as elastic, Velcro, straps, tape, etc. The method of attachment is irrelevant to the purpose of the Throwing Aid, which is to alter the throwing motion.

10 Throwing Aid
12 Base
14 Attachment Means
16 End Portion
18 End Portion
20 Central Curved Portion

22 Slots
24 Velcro Strip
26 Velcro Strip
28 Pile
30 Hook
32 One end of Velcro Strip 24
34 One end of Velcro Strip 26
36 Other end of Velcro Strip 24
38 Other end of Velcro Strip 26
A Angle
P Player
40 Arm
42 Ball

FIG. 6

44 Base
46 Pocket
48 Elastimeric Sleeve (Means of attachment)

NARRATIVE DESCRIPTION OF STRUCTURE

The main body of this invention is referred to as the base 12. The base being flexible but substantially rigid and may be attached to the arm 40 by one of several methods. FIG. 1 shows slots for the attachment means 14. The Velcro strips 24, 26 are placed through the slots 22; the ends of Velcro strips 32 and 34 are adhered together. The other ends of Velcro strips 24 and 26 are then looped around the arm 40, joining Velcro ends 36 and 38 to secure base 12 to arm as shown in FIG. 5. The pile 28 and hook 30 make a secure bonding.

The central curved portion 20 is added for comfort and fit, as is angle A. The angle A and central curved portion 20 could vary from slight to none at all.

FIG. 6 shows the base 44 with a different attachment method, an elastimeric sleeve 48. The player P could simply slide the base 44 into the pocket 46 and pull elastimeric sleeve 48 on the arm A. FIG. 6 shows one of the several attachment options possible.

FIG. 5 shows the effect of throwing aid 10 when attached to player P's arm 40. It is intended to show the player P bringing the ball 42 up over the head while throwing overhand in a circular motion. The phantom portion shows the ball 42 being brought back past the head from in front of the body. With the base 12 in place, the ball 42 can only be thrown in the circular overhand motion with the arm extended.

How the Invention Works

The "Throwing Aid" is to be used in throwing practice as a training device. It should be used only with supervision. Throwing speed should be 50–75% of the user's maximum speed. The "Throwing Aid" should be centered on the elbow and attached by any one of several methods (tape, elastic, Velcro, straps). When attempting to throw a ball overhand, the "Throwing Aid" forces the user to take the ball back past the thigh and on up over the top of the head in a circular or windmill motion. The ball cannot be thrown in a side-arm motion or brought back by the ear in what is called a "short-stroke", an incorrect throwing motion, because the "Throwing Aid" will not permit the elbow to bend enough to do so.

Conclusion

The "Throwing Aid" is designed to correct an improper motion when throwing a ball, specifically "short-stroking" (bringing the ball back by the ear) instead of rotating the arm by the thigh and over the head in a circular motion. The incorrect throwing motion is most common in younger children, but can also be a problem for most females and for some adult males. The size, material and straps on the "Throwing Aid" could vary without affecting the purpose of the "Aid". "Short-Stroking" the ball places a lot of pressure on the shoulder and elbow, increasing the chance of injury and limiting both speed and endurance. When wearing the "Throwing Aid" the user will naturally use his legs to push off, thereby involving more of his body; when completing the throw, the larger arc of the arm allows the fingers and wrist to supply even more force, thus permitting maximum speed and endurance while minimizing chances of injury. By forcing the circular motion, the "Throwing Aid" causes the thrower to involve his entire body to achieve a more desirable throwing motion.

The invention having thus been described, the following is claimed:

1. A throwing aid for assisting in correctly throwing a ball in an overhand, circular throwing motion, said throwing aid comprising:

an elongated flexible but substantially rigid base of approximately a width and length of a thrower's forearm and being curved inwardly along a longitudinal axis of said elongated base so that lateral side edges of said elongated base converge inwardly towards each other and form a concave surface on an inner side of said elongated base, said elongated base having a central portion bent inwardly so that opposite ends of said elongated base converge inwardly towards each other and form an obtuse angle at said central portion between said opposite ends on said inner side of said elongated base, and means for attaching said inner side of said elongated base snugly to a rear side of an arm for only inward slight bending of the arm so that said elongated base is centered on the elbow of a thrower at said central portion and said elongated base forces the thrower to take the ball held in a hand from back past the thigh, up over the top of the head in a circular or windmill motion to throw the ball forward with a large arcuate movement of the arm so as to use the legs to push off while using the fingers and wrist to apply force to the ball and to prevent the elbow from bending so as to throw the ball in an incorrect throwing motion or short-stroke.

* * * * *